US009458676B2

(12) United States Patent
Brinkley et al.

(10) Patent No.: US 9,458,676 B2
(45) Date of Patent: Oct. 4, 2016

(54) WELLBORE ELECTRICAL ISOLATION SYSTEM

(71) Applicant: CHEVRON U.S.A. INC., San Ramon, CA (US)

(72) Inventors: Cole Thomas Brinkley, San Ramon, CA (US); Jacobo Rogelio Archuleta, San Ramon, CA (US)

(73) Assignee: CHEVRON U.S.A. INC., San Ramon, CA (US)

( * ) Notice: Subject to any disclaimer, the term of this patent is extended or adjusted under 35 U.S.C. 154(b) by 0 days.

(21) Appl. No.: 14/381,059

(22) PCT Filed: Mar. 12, 2014

(86) PCT No.: PCT/US2014/024009

§ 371 (c)(1),
(2) Date: Aug. 26, 2014

(87) PCT Pub. No.: WO2014/159526

PCT Pub. Date: Oct. 2, 2014

(65) Prior Publication Data

US 2016/0017671 A1 Jan. 21, 2016

Related U.S. Application Data

(60) Provisional application No. 61/779,936, filed on Mar. 13, 2013.

(51) Int. Cl.

| | |
|---|---|
| ***E21B 17/00*** | (2006.01) |
| ***E21B 17/10*** | (2006.01) |
| ***E21B 47/06*** | (2012.01) |
| ***E21B 47/12*** | (2012.01) |
| ***E21B 17/042*** | (2006.01) |

(52) U.S. Cl.

CPC ..... *E21B 17/003* (2013.01); *E21B 17/042* (2013.01); *E21B 17/1042* (2013.01); *E21B 17/1078* (2013.01); *E21B 47/06* (2013.01); *E21B 47/065* (2013.01); *E21B 47/122* (2013.01)

(58) Field of Classification Search

CPC ..... E21B 17/003; E21B 17/042; E21B 17/1042; E21B 17/1078; E21B 47/06; E21B 47/065; E21B 47/122

See application file for complete search history.

(56) References Cited

U.S. PATENT DOCUMENTS 5,282,508 A * 2/1994 Ellingsen ..... E21B 17/003 166/249
6,515,592 B1 * 2/2003 Babour ..... G01V 11/002 166/66

(Continued)

FOREIGN PATENT DOCUMENTS

WO WO 2012/107107 8/2012

OTHER PUBLICATIONS

International Preliminary Report on Patentability mailed Mar. 11, 2015 for corresponding International Patent Application No. PCT/US2014/024009 (13 pages).

(Continued)

*Primary Examiner* — John Fitzgerald

(74) *Attorney, Agent, or Firm* — Pillsbury Winthrop Shaw Pittman, LLP

(57) ABSTRACT

This disclosure relates to a wellbore electrical isolation system and method. The system may comprise an electrically conductive tube, an insulating layer covering at least a portion of the tube, an electrically conductive centralizer, electrically insulating confinement devices, and/or other components. In some implementations, the system may be configured to electrically isolate one or more sections of an electrically conductive well tubing string from an electrically conductive wellbore casing. In some implementations, a well may include one or more wellbore electrical isolation systems. Electrical isolation of the tubing string from the casing may facilitate powering one or more electrical loads disposed within the wellbore via a coaxial transmission line formed by the casing and the tubing string.

20 Claims, 5 Drawing Sheets

(56) References Cited

U.S. PATENT DOCUMENTS

| | | | | |
|---|---|---|---|---|
| 6,715,550 | B2 * | 4/2004 | Vinegar | E21B 17/003 137/155 |
| 7,605,716 | B2 | 10/2009 | Peter et al. | |
| 2011/0315378 | A1 | 12/2011 | Homan et al. | |

OTHER PUBLICATIONS

International Search Report and Written Opinion dated Jun. 17, 2014 for Appln No. PCT/US2014/024009.

* cited by examiner

WELLBORE ELECTRICAL ISOLATION SYSTEM

CROSS REFERENCE TO RELATED APPLICATIONS

This is the U.S. National Stage of PCT/US2014/024009, filed Mar. 12, 2014, which in turn claims the benefit of priority from U.S. Provisional Application No. 61/779,936, filed Mar. 13, 2013, the entire contents of all applications are incorporated herein by reference in their entirety.

FIELD OF THE DISCLOSURE

This disclosure relates to a wellbore electrical isolation system and method for electrically isolating one or more sections of a tube from a wellbore casing.

BACKGROUND

Systems for sensing characteristics of wellbores without wiring are known. Typically, an electrical connection to a wellbore casing and a tubing string powers one or more down hole gauges and/or actuators from a single installation point. A voltage and current sufficient to drive the gauges and/or actuators must exist across the tubing string and casing at the installation point to provide power to the gauges and/or actuators. Currently, systems for wireless sensing are limited to one or more gauges and/or actuators powered from a single installation point because the voltage and current across the tubing and casing beyond the installation point of the gauges and/or actuators is not sufficient to power additional gauges and/or actuators.

SUMMARY

One aspect of the disclosure relates to a wellbore electrical isolation system. The system may comprise an electrically conductive tube, an insulating layer covering at least a portion of the tube, an electrically conductive centralizer, electrically insulating confinement devices, and/or other components. In some implementations, the system may be configured to electrically isolate one or more sections of an electrically conductive tubing string from an electrically conductive wellbore casing. In some implementations, a well may include one or more wellbore electrical isolation systems.

Electrical isolation of the tubing string from the casing may facilitate powering one or more electrical loads disposed within the wellbore via a coaxial transmission line formed by the casing and the tubing string. In some implementations, the tubing string may have a positive polarity and the casing may have a negative polarity. By way of an electrical engagement between the casing and the centralizer, the centralizer may also have a negative polarity. In some implementations, a given electrical load may be electrically coupled with the positive tubing string and separately coupled with the negative centralizer. The centralizer and the tubing string may be electrically isolated from each other by the insulating layer covering at least a portion of the tube. This arrangement may allow additional electrical loads to be deployed in the same and/or similar manner distally (down hole) from the given electrical load.

The electrically conductive tube may have a first end and a second end. At least a portion of an outside diameter of the tube between the first end and the second end may be covered with the electrically insulating layer.

The electrically conductive centralizer may be coupled to the insulating layer. The centralizer may be coupled to the insulating layer such that the centralizer and the tube are electrically insulated from each other. Movement of the centralizer longitudinally along the tube may be confined by a first electrically insulating confinement device toward the first end of the tube and a second electrically insulating confinement device toward the second end of the tube. The centralizer may be configured to engage the conductive wellbore casing to maintain a physical separation between the tube and the casing. The electrical insulation between the centralizer and the tube may isolate the tube electrically from the casing.

In some implementations, the casing may be configured to surround the tube, the insulating layer, the centralizer, the first confinement device, the second confinement device, and/or other components of the system.

In some implementations, the system may include the one or more loads electrically coupled with the tube and the centralizer separately. The one or more loads may include one or more sensors, one or more actuators, and/or other loads. The one or more sensors may include one or more of a temperature sensor, a pressure sensor, a flow rate sensor, a voltage sensor, and/or other sensors. The one or more actuators may include a valve, and/or other actuators. The one or more loads may communicate with an interior of the tube. The one or more loads may be configured to generate output signals conveying information related to operation of a well. The information related to the operation of the well may include one or more of information related to a temperature in the tube, a pressure in the tube, a flow rate of material through the tube, the operational state of a valve (e.g., open, closed, partially open), and/or other information. The tube, the centralizer, the tubing string, the casing, and/or other components of the well may be configured to provide a signal path for the output signals.

In some implementations, the wellbore electrical isolation system may be a pup joint assembly. The first end and the second end of the tube are threaded such that the system may be coupled in line with the tubing string.

Another aspect of the disclosure is related to a method for electrically isolating well components with a wellbore electrical isolation system. The method may comprise covering, with an electrically insulating layer, an electrically conductive tube having a first end and a second end, wherein at least a portion of an outside diameter of the tube between the first end and the second end is covered with the insulating layer. The method may comprise coupling an electrically conductive centralizer to the insulating layer such that the centralizer and the tube are electrically insulated from each other. The method may comprise confining movement of the centralizer longitudinally along the tube with a first electrically insulating confinement device toward the first end of the tube and a second electrically insulating confinement device toward the second end of the tube. The method may comprise engaging, with the centralizer, a conductive wellbore casing to maintain a physical separation between the tube and the casing, wherein the electrical insulation between the centralizer and the tube isolates the tube electrically from the casing.

The method may comprise surrounding, with the casing, the tube, the insulating layer, the centralizer, the first confinement device, the second confinement device, and/or other components.

The method may comprise electrically coupling one or more loads with the tube and the centralizer separately. The one or more loads may include one or more sensors, one or more actuators, and/or other loads. The one or more sensors may include one or more of a temperature sensor, a pressure sensor, a flow rate sensor, a voltage sensor, and/or other sensors. The one or more actuators may include a valve, and/or other actuators. The one or more loads may communicate with an interior of the tube. The one or more loads may generate output signals conveying information related to operation of a well. The information related to the operation of the well may include one or more of information related to a temperature in the tube, a pressure in the tube, a flow rate of material through the tube, the operational state of a valve (e.g., open, closed, partially open), and/or other information. The method may comprise providing a signal path for the output signals with one or more of the tube, the centralizer, or the casing.

In some implementations, the wellbore electrical isolation system in the method described above may be a pup joint assembly. The first end and the second end of the tube in the method described above may be threaded such that the system may be coupled in line with a tubing string.

These and other features, and characteristics of the present technology, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
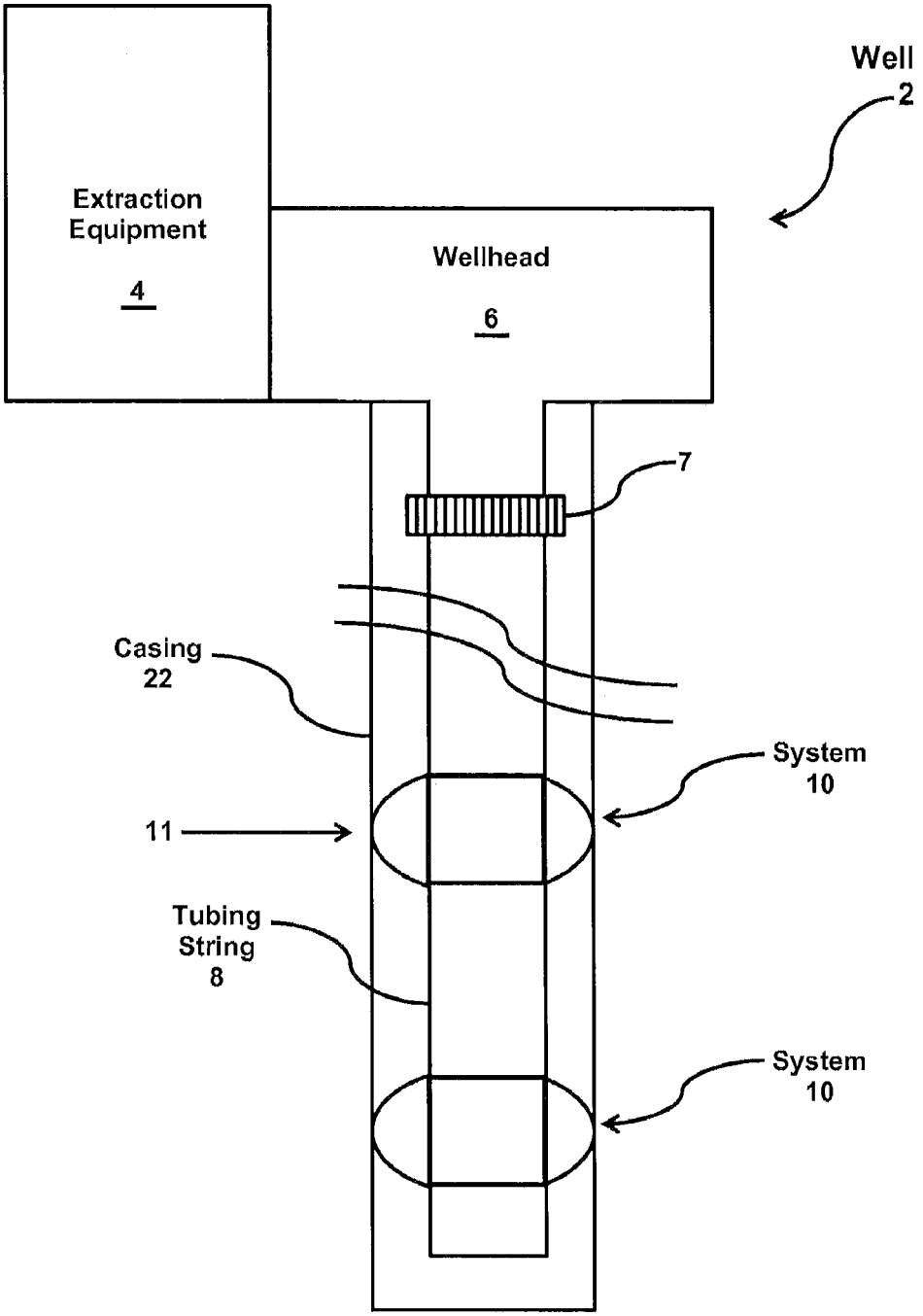
FIG. 1 illustrates a well configured to communicate liquid and/or gas from an underground reservoir to above ground extraction equipment at or near a wellhead.

FIG. 1 illustrates a well 2 configured to communicate liquid and/or gas from an underground reservoir to above ground extraction equipment 4 at or near a wellhead 6. In some implementations, well 2 may include one or more wellbore electrical isolation systems 10. In some implementations, systems 10 may be configured to electrically isolate one or more sections of an electrically conductive tubing string 8 from an electrically conductive wellbore casing 22. Casing 22 may cooperate with tubing string 8 to form a coaxial transmission line. Electrical isolation of tubing string 8 from casing 22 may facilitate powering one or more electrical loads disposed within well 2 via the coaxial transmission line formed by casing 22 and tubing string 8 without the need for electrical wiring. Systems 10 may be configured such that voltage and/or current across tubing string 8 and casing 22 distally (e.g., down hole) from a first installation point 11 is sufficient to power additional loads located distally from first installation point 11. In some implementations, systems 10 may be formed in and/or formed by pup joints. A pup joint may comprise a relatively short (relative to tubing string 8) length of tube configured to couple in line with tubing string 8.

Figure 2:
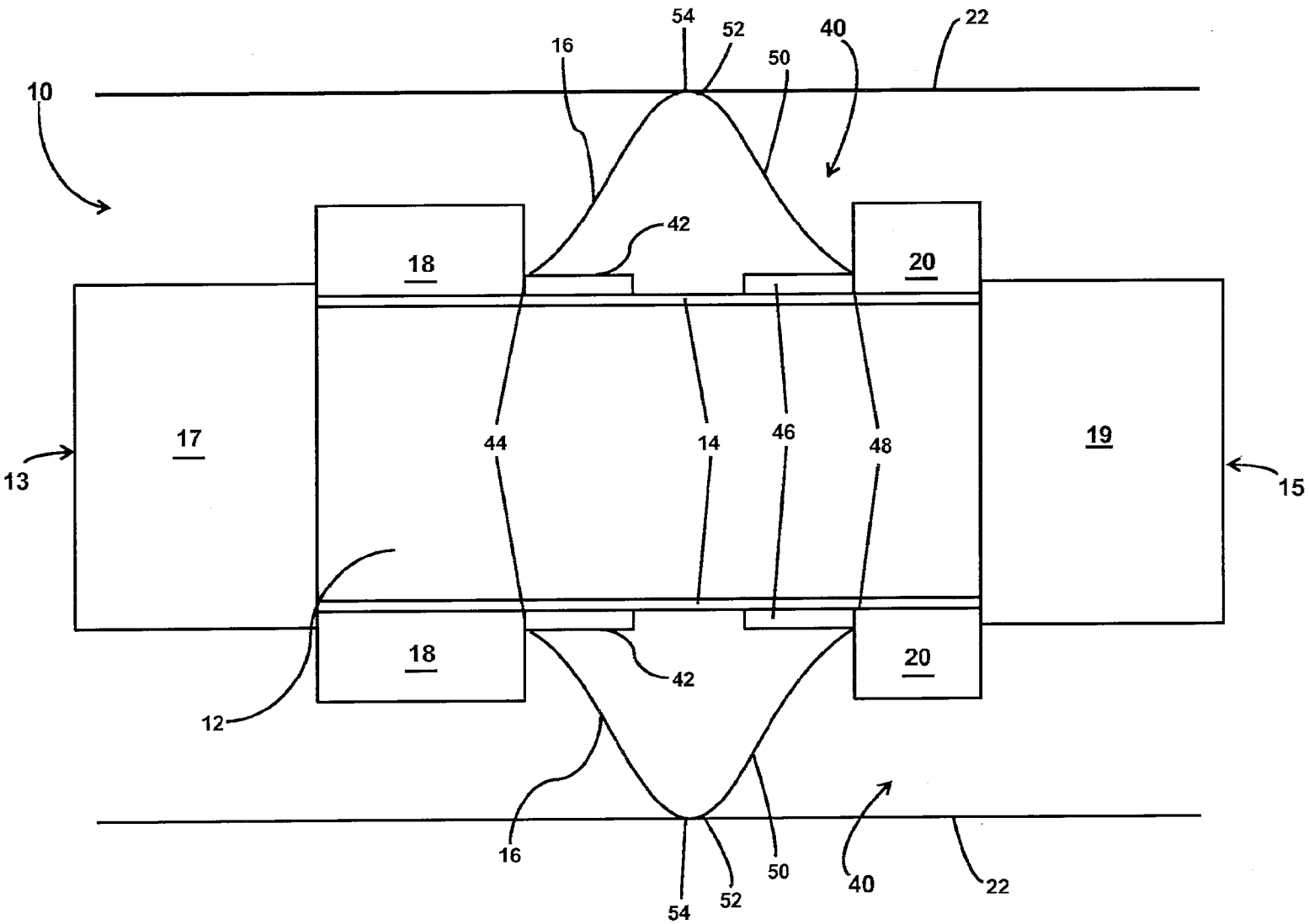
FIG. 2 illustrates a cross sectional view of a wellbore electrical isolation system.

FIG. 2 illustrates a cross sectional view of a wellbore electrical isolation system 10. In some implementations, wellbore electrical isolation system 10 may comprise a tube 12, an electrically insulating layer 14, a centralizer 16, a first electrically insulating confinement device 18, a second electrically insulating confinement device 20, and/or other components.

Tube 12 may be configured to communicate liquid and/or gas during mineral extraction. Tube 12 may have a first end 13 and a second end 15. A first box 17 at first end 13 and a second box 19 at second end 15 may comprise threaded portions of tube 12 such that tube 12 may be coupled in line with a tubing string (e.g., tubing string 8 shown in FIG. 1). The tubing string may be configured to communicate the liquid and/or gas from an underground reservoir to above ground extraction equipment. Tube 12 and/or the tubing string may be made from electrically conductive materials such as steel and/or other electrically conductive materials.

Electrically insulating layer 14 may be configured to cover at least a portion of an outside diameter of tube 12 between first end 13 and second end 15. For example, insulating layer 14 may cover a portion of the outside diameter of tube 12 that is about six feet long. Insulating layer 14 may be formed from electrically insulating materials including ceramics, polymers, and/or other insulating materials. For example, insulating layer 14 may be formed from polymer materials such as polyether ether ketone (PEEK), relatively tough (e.g., less brittle) ceramics, and/or other materials. In some implementations, insulating layer 14 may be applied during manufacture of system 10 and/or at other times. In some implementations, insulating layer 14 may self-adhere to tube 12. In some implementations, insulating layer 14 may be coupled with tube 12 via one or more coupling devices. The one or more coupling devices may include, for example, a clamp, a collar, a latch, a hook, adhesive, and/or other devices. For example, insulating layer 14 may be sprayed onto tube 12, painted onto tube 12, adhered to tube 12 with an adhesive, clamped to tube 12 with one or more clamps, and/or attached to tube 12 via other methods.

Centralizer 16 may be configured to couple with insulating layer 14. Centralizer 16 may couple with insulating layer 14 via one or more coupling devices of the centralizer and/or one or more external coupling devices. The coupling devices of the centralizer and/or the one or more external coupling device may include, for example, a clamp, a collar, a latch, a hook, adhesive, and/or other coupling devices. Centralizer 16 may be made from electrically conductive materials such as steel and/or other electrically conductive materials. Centralizer 16 may be configured to couple with insulating layer 14 such that centralizer 16 and tube 12 are electrically insulated from each other. Centralizer 16 may be configured to engage casing 22 to maintain a physical separation between tube 12 and casing 22. Engagement between centralizer 16 and casing 22 may include an electrically conductive engagement. Insulating layer 14 between centralizer 16 and tube 12 may electrically isolate tube 12 from casing 22.

Centralizer 16 may include a bow spring centralizer, a torque engaged centralizer, and/or other centralizers. A bow spring centralizer may have a first collar 42 at a first end 44 and a second collar 46 at a second end 48. In some implementations, first collar 42 may be located proximally (up hole) relative to second collar 46 located distally (down hole) in the wellbore. In some implementations, first collar 42 and second collar 46 may be hinged. First collar 42 and second collar 46 may secure the bow spring centralizer to insulating layer 14. The first hinged collar and the second hinged collar may be coupled together via bow springs 50 arranged circumferentially around collars 42 and 46. The bow springs may bow such that the bow spring centralizer has a maximum diameter 52 at or near a mid-point 54 between first collar 42 and second collar 46. Individual ones of bow springs 50 may engage casing 22 to maintain a physical separation between tube 12 and casing 22 at or near maximum diameter 52 of the bow spring centralizer.

Movement of centralizer 16 longitudinally along tube 12 may be confined by first electrically insulating confinement device 18 toward first end 13 of tube 12 and second electrically insulating confinement device 20 toward second end 15 of tube 12. First electrically insulating confinement device 18 and second electrically insulating confinement device 20 may be formed from electrically insulating materials such as ceramics, polymers, and/or other insulating materials. The electrically insulating materials may be configured to withstand the operating conditions within a subsurface wellbore for the extraction of fossil fuels. For example, the electrically insulating materials may be configured such that they do not melt or deform when exposed to elevated temperatures. First confinement device 18 may be a first sleeve surrounding tube 12 disposed between centralizer 16 and first end 13. Second confinement device 20 may be a second sleeve surrounding tube 12 disposed between centralizer 16 and second end 15.

Tube 12 and/or the tubing string (e.g., tubing string 8 shown in FIG. 1) may be provided within casing 22. Casing 22 may surround tube 12, insulating layer 14, centralizer 16, first confinement device 18, second confinement device 20, and/or other components of system 10. Providing tube 12 within casing 22 may create an inner annular space 40 between the outer surface of tube 12 and casing 14. Centralizer 16 may be configured to maintain tube 12 in annular space 40 to maintain the physical separation between tube 12 and casing 22. Casing 22 may line the wellbore and provide structural support to the wellbore. Casing 22 may separate the well from subsurface materials (e.g., rocks, dirt, etc.), water (e.g., in the case of a well in the ocean floor), and/or other environmental materials. Casing 22 may be made from a conductive material such as steel and/or other conductive materials.

Figure 3:
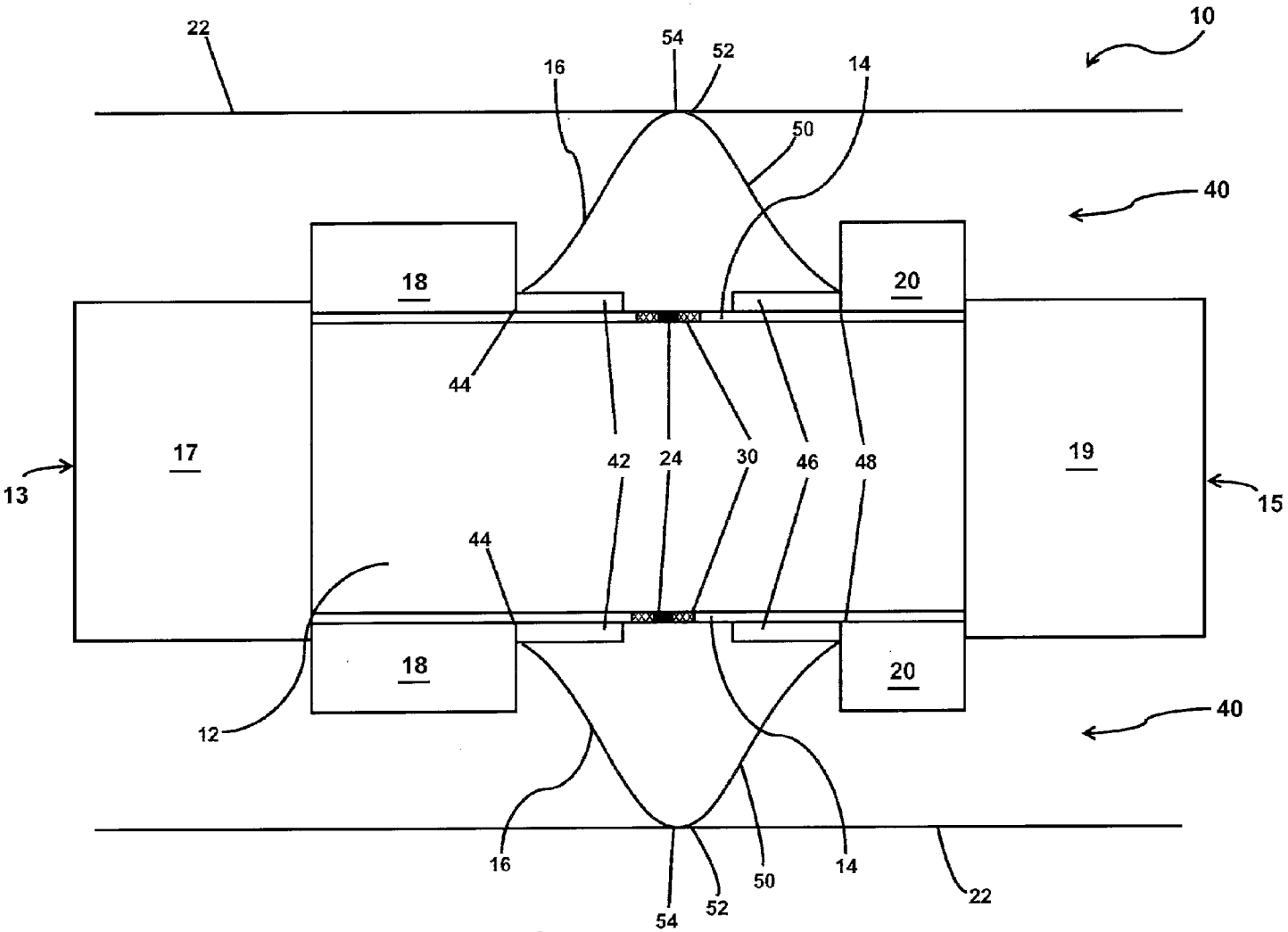
FIG. 3 illustrates a cross sectional view of an implementation of the wellbore electrical isolation system that includes one or more electrical loads.

FIG. 3 illustrates a cross sectional view of an implementation of system 10 that includes one or more electrical loads 24. One or more loads 24 may be electrically coupled with tube 12 and centralizer 16 separately. One or more loads 24 may include one or more sensors, one or more actuators, and/or other loads. The one or more sensors may include one or more of a temperature sensor, a pressure sensor, a flow rate sensor, a voltage sensor, and/or other sensors. The one or more actuators may include a valve, and/or other actuators. In some implementations, one or more of the loads may communicate with an interior of tube 12. In some implementations one or more of the loads may communicate with the interior of tube 12 via a communication port coupled with one or more of the loads and the interior of tube 12. The one or more loads 24 may be configured to generate output signals conveying information related to operation of a well (e.g., well 2 shown in FIG. 1). The information related to the operation of the well may include one or more of information related to a temperature in tube 12, a pressure in tube 12, a flow rate of material through tube 12, the operational state of a valve (e.g., open, closed, partially open), and/or other information. In some implementations, tube 12, centralizer 16, casing 22, the tubing string (e.g., tubing string 8 shown in FIG. 1), and/or other components of the well may be configured to provide a signal path for the output signals.

In some implementations, one or more loads 24 may be disposed in a load cavity 30 of system 10. Load cavity 30 may comprise a vacant space configured to receive and/or couple with one or more loads 24. Load cavity 30 may communicate with the communication port. Load cavity 30 may include pathways and/or channels such that loads 24 may be electrically coupled with tube 12 and centralizer 16 separately as described above. In FIG. 3, load cavity 30 is illustrated within insulating layer 14. This is not intended to be limiting. Load cavity 30 may be located anywhere in system 10 that allows one or more loads 24 to function as described herein.

Returning to FIG. 1, as described above, casing 22 may cooperate with tubing string 8 to form a coaxial transmission line. Electrical isolation of tubing string 8 from casing 22 may facilitate powering one or more electrical loads disposed within well 2 via the coaxial transmission line formed by casing 22 and tubing string 8. In some implementations, tubing string 8 may have a positive polarity and casing 22 may have a negative polarity. By way of the electrical engagement between casing 22 and centralizer 16 (shown in FIG. 2), centralizer 16 may also have a negative polarity. In some implementations, an electrical load, (e.g., one or more loads 24 that may include sensors and/or actuators, and/or other loads) may be electrically coupled with the electrically positive tubing string 8 and separately with the electrically negative centralizer 16 (shown in FIG. 2). Centralizer 16 (shown in FIG. 3) and tubing string 8 may be electrically isolated from each other by insulating layer 14 (shown in FIG. 3) covering at least a portion of tube 12 (shown in FIG. 3). This arrangement may allow additional electrical loads to be deployed in the same and/or similar manner distally (down hole).

Figure 3A:
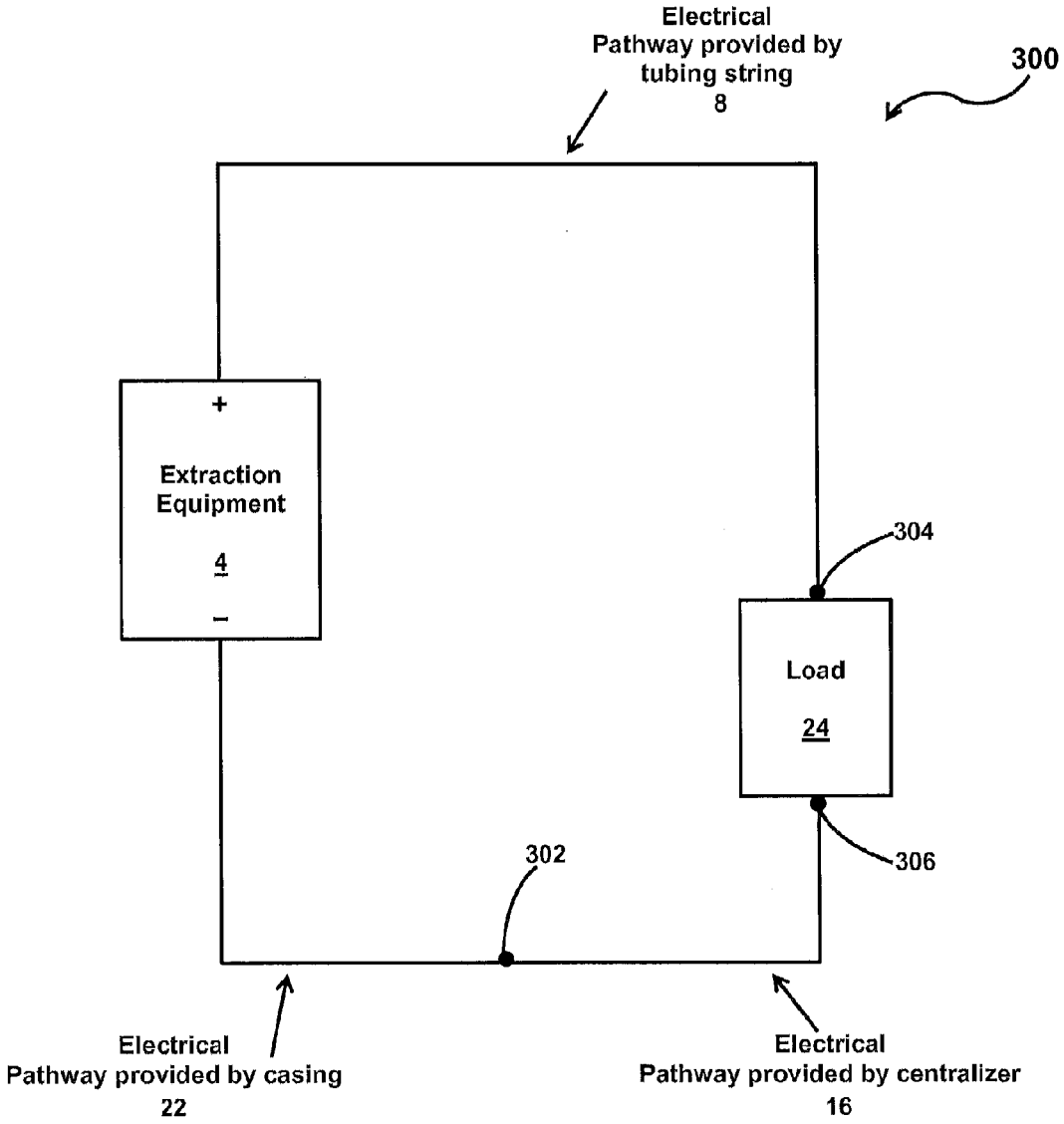
FIG. 3A illustrates an electrical circuit formed by a tubing string, a load, a centralizer, a casing, and extraction equipment.

For example, FIG. 3A illustrates an electrical circuit 300 formed by an electrical pathway provided by tubing string 8, a load 24, centralizer 16, casing 22, and extraction equipment 4. Extraction equipment 4 may include a power supply. In the example shown in FIG. 3A, the electrical pathway provided by tubing string 8 may have a positive polarity and the electrical pathway provided by casing 22 may have a negative polarity. By way of the electrical engagement 302 between casing 22 and centralizer 16, the electrical pathway provided by centralizer 16 may also have a negative polarity. In some implementations, electrical load 24 may be electrically coupled with the electrically positive tubing string 8 at location 304 and separately at location 306 with the electrically negative centralizer 16.

Returning to FIG. 1, in some implementations, extraction equipment 4 may include equipment configured to manage operation of well 2. Managing the operation of well 2 may include drawing liquid and/or gas through well 2, storing the liquid and/or gas, monitoring well 2, powering well 2, preparing well 2 for production, analyzing data related to the operation of well 2, and/or other activities. Such equipment may include pumps, piping, wiring, liquid and/or gas storage devices, power supplies, data processing equipment (e.g., one or more computers and/or processors), communication equipment, cameras, and/or other extraction equipment. For example, a well power supply may be configured to supply a positive polarity to tubing string 8 and a negative polarity to casing 22. As another example, one or more processors may be configured to determine one or more well parameters based on output signals from one or more loads disposed within the wellbore. Such well parameters may include, for example, a temperature, a pressure, a flow rate, and/or other parameters.

Wellhead 6 may be located at the surface of well 2. Wellhead 6 may be configured to suspend tubing string 8 and/or casing 22 in well 2. Wellhead 6 may be a structural interface between tubing string 8 and extraction equipment 4 configured to couple tubing string 8 with extraction equipment 4. Wellhead 6 may be configured to contain pressure present in well 2. Wellhead 6 may be configured to provide physical access to well 2 including access to annular space(s) (e.g., annular space 40 shown in FIG. 2) between casing (e.g., casing 22) and/or tubing strings (e.g., tubing string 8). Wellhead 6 may be configured to provide electrical ports that are electrically coupled with tubing string 8 and/or casing 22.

In some implementations, tubing string electrical insulation device 7 may electrically insulate tubing string 8 from wellhead 6. In some implementations, tubing string electrical insulation device 7 may be configured to electrically insulate tubing string 8 from wellhead 6 magnetically, by physically separating metal in wellhead 6 from metal in tubing string 8, and/or by other methods. In some implementations, tubing string electrical insulation device 7 may be and/or include a transformer, for example.

It will be appreciated by those having ordinary skill in the art that tubing string 8 may take different forms depending on the state of the wellbore. Thus, for example, tubing string 8 may comprise a production tubing string in a completed wellbore or a drillstring in a wellbore under construction.

Figure 4:
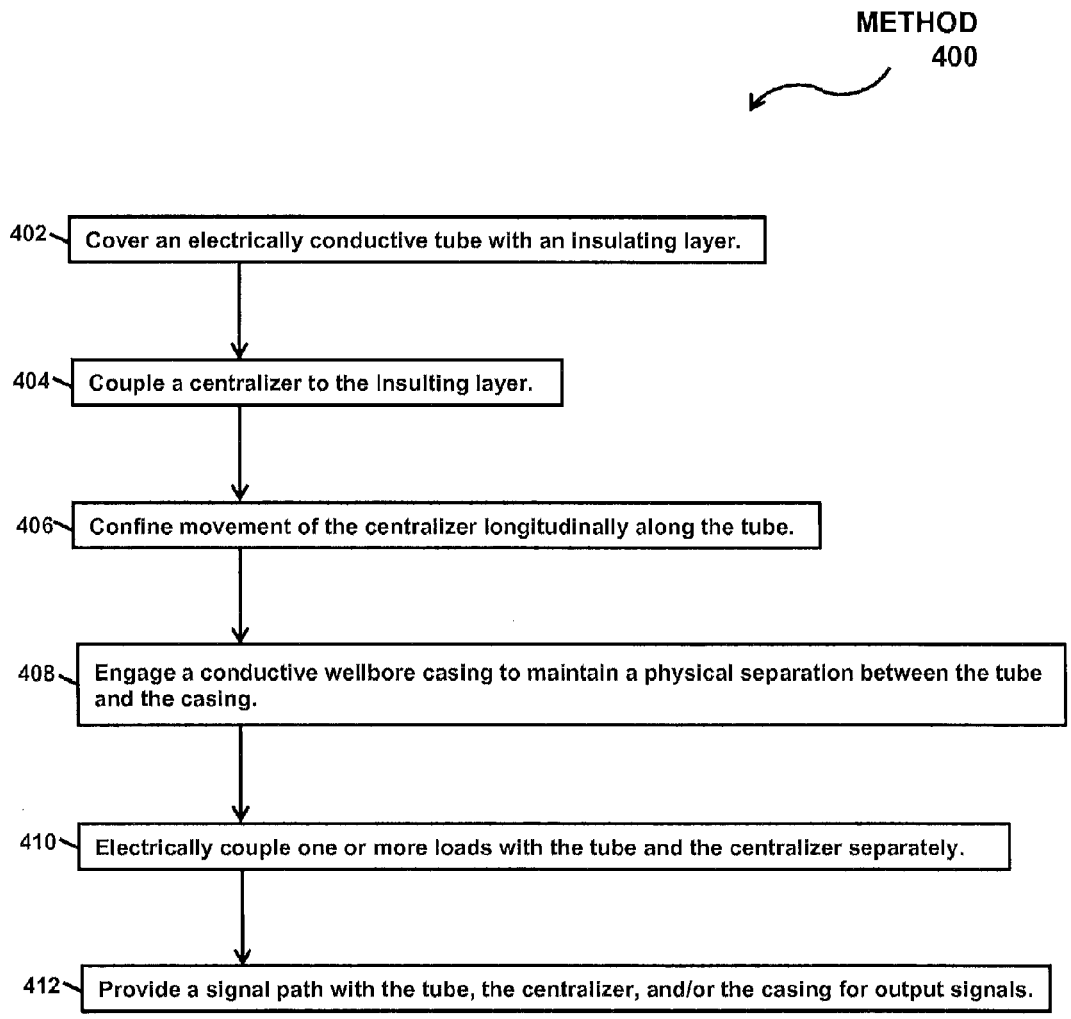
FIG. 4 illustrates a method for electrically isolating well components with a wellbore electrical isolation system.

FIG. 4 illustrates a method 400 for electrically isolating well components with a wellbore electrical isolation system. In some implementations, the wellbore electrical isolation system may be a pup joint assembly. The operations of method 400 presented below are intended to be illustrative. In some implementations, method 400 may be accomplished with one or more additional operations not described, and/or without one or more of the operations discussed. Additionally, the order in which the operations of method 400 are illustrated in FIG. 4 and described herein is not intended to be limiting.

At an operation 402, an electrically conductive tube may be covered with an electrically insulating layer. The tube may have a first end and a second end. At least a portion of an outside diameter of the tube between the first end and the second end may be covered with the insulating layer. In some implementations, the first end and the second end of the tube may be threaded. In some implementations, operation 402 may be performed by an insulating layer the same as or similar to insulating layer 14 (shown in FIG. 2 and described herein).

At an operation 404, an electrically conductive centralizer may couple with the insulating layer. The coupling may be performed, for example, by a collar, latch, hook, and/or other components of the centralizer. The centralizer and the tube may be coupled such that they are electrically insulated from each other. In some implementations, operation 404 may be performed by a centralizer the same as or similar to centralizer 16 (shown in FIG. 2 and described herein).

At an operation 406, movement of the centralizer longitudinally along the tube may be confined. Movement of the centralizer may be confined with a first electrically insulating confinement device toward the first end of the tube and a second electrically insulating confinement device toward the second end of the tube. In some implementations, operation 406 may be performed by confinement devices the same as or similar to confinement devices 18 and/or 20 (shown in FIG. 2 and described herein).

At an operation 408, a conductive wellbore casing may be engaged to maintain a physical separation between the tube and the casing. The casing may be engaged with the centralizer. The electrical insulation between the centralizer and the tube may isolate the tube electrically from the casing. The casing may surround the tube, the insulating later, the centralizer, the first confinement device, the second confinement device, and/or other components of system 10. In some implementations, operation 408 may be performed by a centralizer the same as or similar to centralizer 16 (shown in FIG. 2 and described herein).

At an operation 410, one or more loads may electrically couple with the tube and the centralizer separately. The one or more loads may include one or more sensors, one or more actuators, and/or other loads. The one or more sensors may include one or more of a temperature sensor, a pressure sensor, a flow rate sensor, a voltage sensor, and/or other sensors. The one or more actuators may include a valve, and/or other actuators. In some implementations, one or more of the loads may communicate with an interior of the tube. In some implementations, the one or more loads may be configured to generate output signals conveying information related to operation of a well. The information related to the operation of the well may include one or more of information related to a temperature in the tube, a pressure in the tube, or a flow rate of material through the tube, the operational state of a valve (e.g., open, closed, partially open). In some implementations, operation 410 may be performed by one or more loads the same as or similar to loads 24 (shown in FIG. 3 and described herein).

At an operation 412, a signal path for the output signals of the one or more loads may be provided. The signal path may be provided with the tube, the centralizer, the casing, and/or other components of the wellbore electrical isolation system. In some implementations, operation 412 may be performed by a tube, a centralizer, and/or a casing the same as or similar to tube 12, centralizer 16, and/or casing 22 (shown in FIG. 2 and described herein).

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

What is claimed is:

1. A wellbore electrical isolation system, the system comprising:

an electrically conductive tube having a first end and a second end, wherein at least a portion of an outside diameter of the tube between the first end and the second end is covered with an electrically insulating layer; and an electrically conductive centralizer, the centralizer being coupled to the insulating layer such that the centralizer and the tube are electrically insulated from each other, wherein movement of the centralizer longitudinally along the tube is confined by a first electrically insulating confinement device toward the first end of the tube and a second electrically insulating confinement device toward the second end of the tube, wherein the centralizer is configured to engage a conductive wellbore casing to maintain a physical separation between the tube and the casing, and wherein the electrical insulation between the centralizer and the tube isolates the tube electrically from the casing.

2. The system of claim 1, wherein the casing surrounds the tube, the insulating layer, the centralizer, the first confinement device, and the second confinement device.

3. The system of claim 1, wherein the wellbore electrical isolation system is a pup joint assembly.

4. The system of claim 1, wherein the first end and the second end of the tube are threaded.

5. The system of claim 1, further comprising one or more loads electrically coupled with the tube and the centralizer separately.

6. The system of claim 5, wherein the one or more loads include one or more sensors and/or one or more actuators.

7. The system of claim 6, wherein the one or more sensors include one or more of a temperature sensor, a pressure sensor, a flow rate sensor, or a voltage sensor.

8. The system of claim 6, wherein the one or more loads communicate with an interior of the tube.

9. The system of claim 6, wherein the one or more loads are configured to generate output signals conveying information related to operation of a well, the information related to the operation of the well including one or more of information related to a temperature in the tube, a pressure in the tube, or a flow rate of material through the tube.

10. The system of claim 9, wherein one or more of the tube, the centralizer, or the casing are configured to provide a signal path for the output signals.

11. A method for electrically isolating well components with a wellbore electrical isolation system, the method comprising:

covering, with an electrically insulating layer, an electrically conductive tube having a first end and a second end, wherein at least a portion of an outside diameter of the tube between the first end and the second end is covered with the insulating layer;

coupling an electrically conductive centralizer to the insulating layer such that the centralizer and the tube are electrically insulated from each other;

confining movement of the centralizer longitudinally along the tube with a first electrically insulating confinement device toward the first end of the tube and a second electrically insulating confinement device toward the second end of the tube; and engaging, with the centralizer, a conductive wellbore casing to maintain a physical separation between the tube and the casing, wherein the electrical insulation between the centralizer and the tube isolates the tube electrically from the casing.

12. The method of claim 11, further comprising surrounding, with the casing, the tube, the insulating layer, the centralizer, the first confinement device, and the second confinement device.

13. The method of claim 11, wherein the wellbore electrical isolation system is a pup joint assembly.

14. The method of claim 11, wherein the first end and the second end of the tube are threaded.

15. The method of claim 11, further comprising electrically coupling one or more loads with the tube and the centralizer separately.

16. The method of claim 15, wherein the one or more loads include one or more sensors and/or one or more actuators.

17. The method of claim 16, wherein the one or more sensors include one or more of a temperature sensor, a pressure sensor, a flow rate sensor, or a voltage sensor.

18. The method of claim 16, further comprising communicating, with the one or more loads, with an interior of the tube.

19. The method of claim 16, further comprising generating output signals conveying information related to operation of a well, the information related to the operation of the well including one or more of information related to a temperature in the tube, a pressure in the tube, or a flow rate of material through the tube.

20. The method of claim 19, further comprising providing a signal path for the output signals with one or more of the tube, the centralizer, or the casing.

* * * * *